US007581848B1

(12) United States Patent
Parsons et al.

(10) Patent No.: US 7,581,848 B1
(45) Date of Patent: Sep. 1, 2009

(54) FLASHLIGHT WITH REPLACEABLE HOUSING

(76) Inventors: Kevin L. Parsons, 2511 E. Capital Dr., Appleton, WI (US) 54915; Dennis Keenan, 3866 Jupiter Crescent Dr., Traverse City, MI (US) 49684

( * ) Notice: Subject to any disclaimer, the term of this patent is extended or adjusted under 35 U.S.C. 154(b) by 0 days.

(21) Appl. No.: 11/809,146

(22) Filed: May 31, 2007

Related U.S. Application Data

(60) Provisional application No. 60/888,615, filed on Feb. 7, 2007.

(51) Int. Cl.
*F21L 4/04* (2006.01)

(52) U.S. Cl. ..... 362/206; 200/60

(58) Field of Classification Search ..... 362/188, 362/199, 205, 206; 200/60
See application file for complete search history.

(56) References Cited

U.S. PATENT DOCUMENTS

| | | | | |
|---|---|---|---|---|
| 6,709,129 | B2 * | 3/2004 | Galli | 362/206 |
| 7,357,534 | B2 * | 4/2008 | Snyder | 362/294 |
| 2008/0013308 | A1 * | 1/2008 | Kang et al. | 362/205 |

* cited by examiner

*Primary Examiner*—John A Ward
(74) *Attorney, Agent, or Firm*—Husch Blackwell Sanders Welsh & Katz

(57) ABSTRACT

A flashlight is provided. The flashlight includes a LED light source, a power circuit that provides power to the LED light source and a buck and boost power controller within the power circuit in series with the LED light source where the buck and boost circuit boosts a battery voltage to the light source when the battery voltage is below the predetermined voltage and reduces the battery voltage to the light source when the battery voltage exceeds the predetermined voltage.

19 Claims, 7 Drawing Sheets

FLASHLIGHT WITH REPLACEABLE HOUSING

FIELD OF THE INVENTION

The field of the invention relates to flashlights and more particularly to flashlights used by police or military personnel.

BACKGROUND OF THE INVENTION

Flashlights are generally known. Flashlights are generally constructed with a housing that holds a set of batteries. A switch and light source is typically located on an outer surface of the housing. The switch is connected in series with the light source and batteries.

Flashlights relied upon by the police and/or the military are used in different ways and have different requirements than flashlights used by civilians. For example, police or military personnel are often required to carry a great deal of equipment in order to achieve their assigned goals. Because of the equipment carried by police or military personnel, the size, weight and configuration of a flashlight is of critical importance. If a flashlight is bulky or heavy, then the flashlight may be left behind. If the office or military person is suddenly confronted by a threat in a darkened area, the absence of a flashlight could place the person's life in peril.

A flashlight carried by police or military personnel must also be reliable. In this regard, light sources (e.g., bulbs) that could easily burn out from use or are easily damaged from shock cannot be tolerated. In addition, the flashlight must provide a superior light output to weight ratio with a predictably long battery life.

Moreover, flashlights used by police or military personnel should not easily become weapons that can be used against the carrier. For this reason, a flashlight used by a police officer or military person should be compact and relatively small. However, even in keeping with the concept of small size, the flashlight should be adaptable to different battery configurations in order to accomplish different missions without loss of utility. Accordingly, a need exists for a flashlight that is small, yet adaptable, for the needs of police and military personnel.

SUMMARY

A flashlight is provided that includes a LED light source, a power circuit that provides power to the LED light source and a buck and boost power controller within the power circuit in series with the LED light source where the buck and boost circuit boosts a battery voltage to the light source when the battery voltage is below the predetermined voltage and reduces the battery voltage to the light source when the battery voltage exceeds the predetermined voltage.

DETAILED DESCRIPTION OF AN ILLUSTRATED EMBODIMENT

Figure 1:
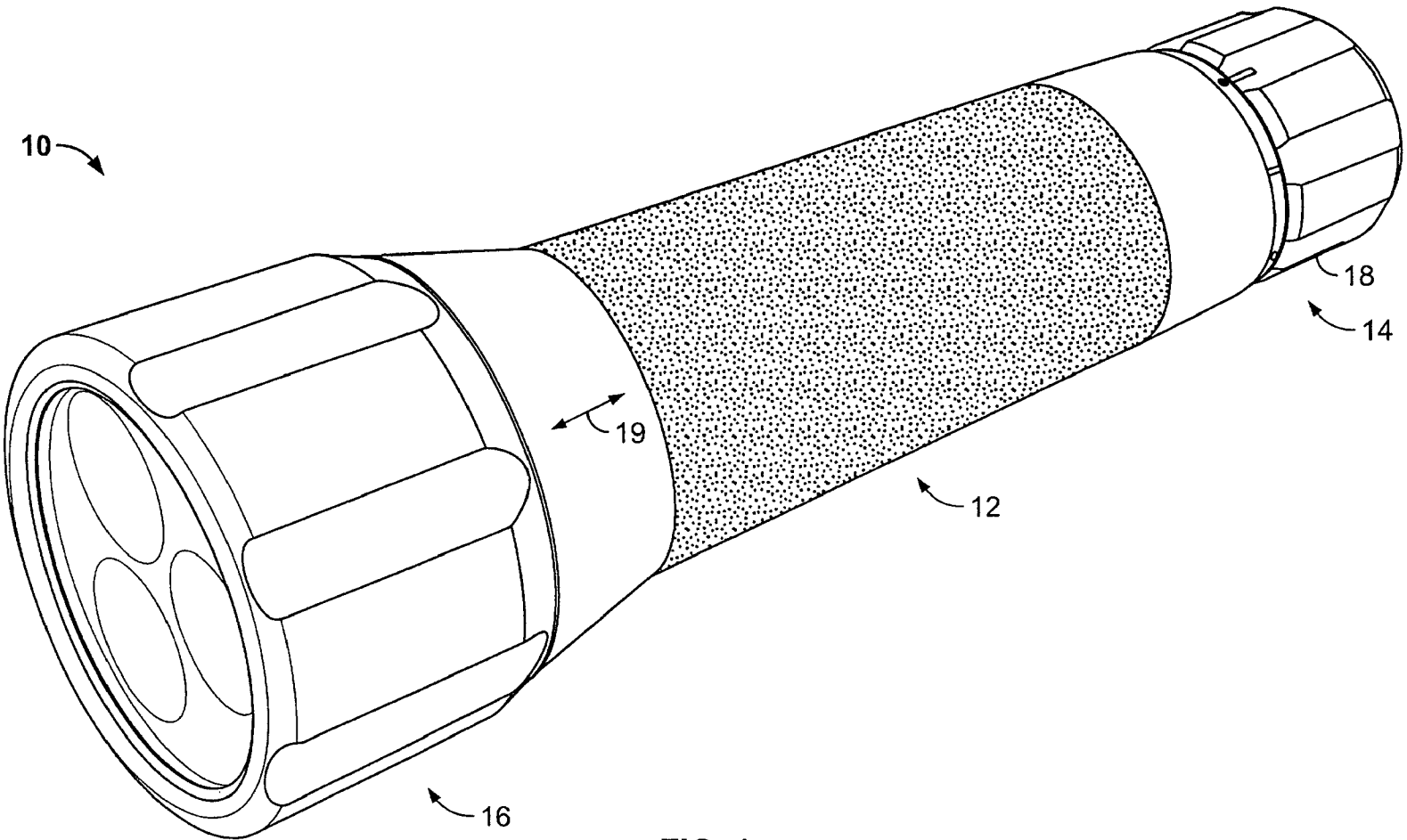
FIG. 1 shows a flashlight with a mode selector in accordance with an illustrated embodiment of the invention.

FIG. 1 is a side view of a flashlight 10 shown generally in accordance with an illustrated embodiment of the invention. The flashlight 10 includes a housing 12, a light source assembly 16 on a first end of the flashlight 10 and a switch control assembly 14 on a second end of the flashlight 10.

The switch control assembly 14 is provided with a rotatable cap (i.e., a mode selector) 18 extending axially from the second end of the housing. The mode selector 18 rotates around a predominant axis 19 of the housing 12.

Figure 2:
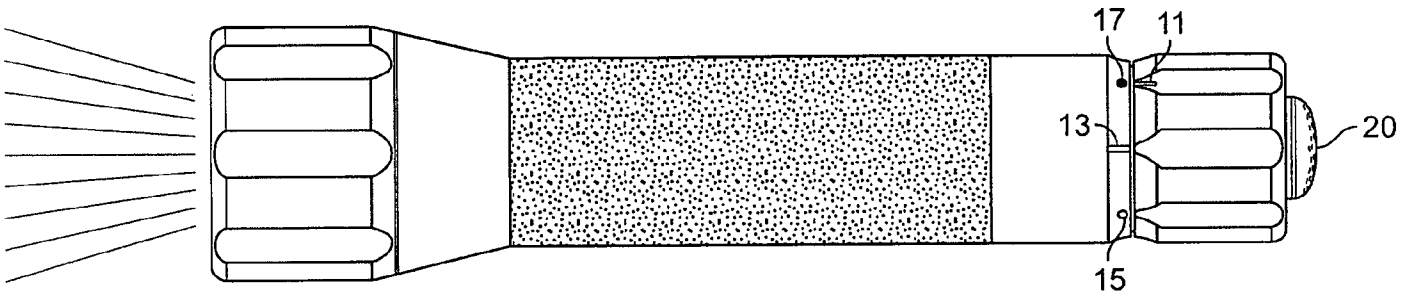
FIG. 2 shows the flashlight of FIG. 1 with the mode selector in a third position.

A spring-loaded pushbutton 20 extends axially from a distal end of the mode selector cap 18 (FIG. 2). As used herein, a spring-loaded pushbutton is a pushbutton that must be activated by an external force (e.g., the finger of a user) and that returns to the same deactivated state each time the external force is removed.

Figure 3:
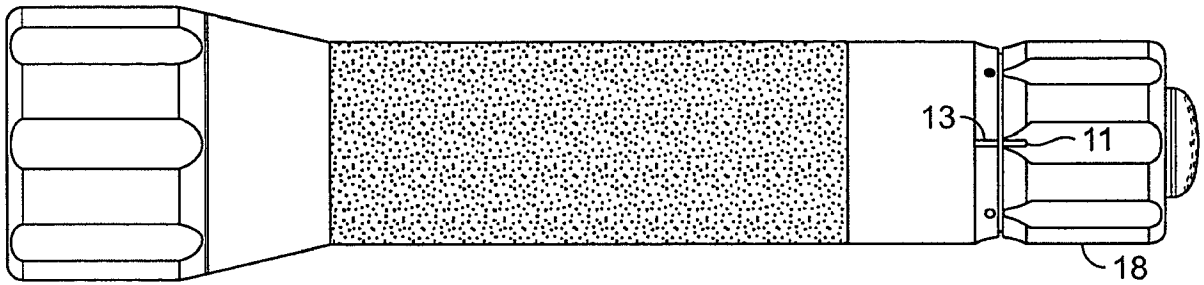
FIG. 3 shows the flashlight of FIG. 1 with the mode selector in a first position.

The mode selector cap 18 has a first position of rotation wherein the light source cannot be activated. The position wherein the light source cannot be activated is shown in FIG. 3 wherein the short horizontal line 11 on the mode selector 18 is aligned with the short horizontal line 13 on the housing 12.

Figure 4:
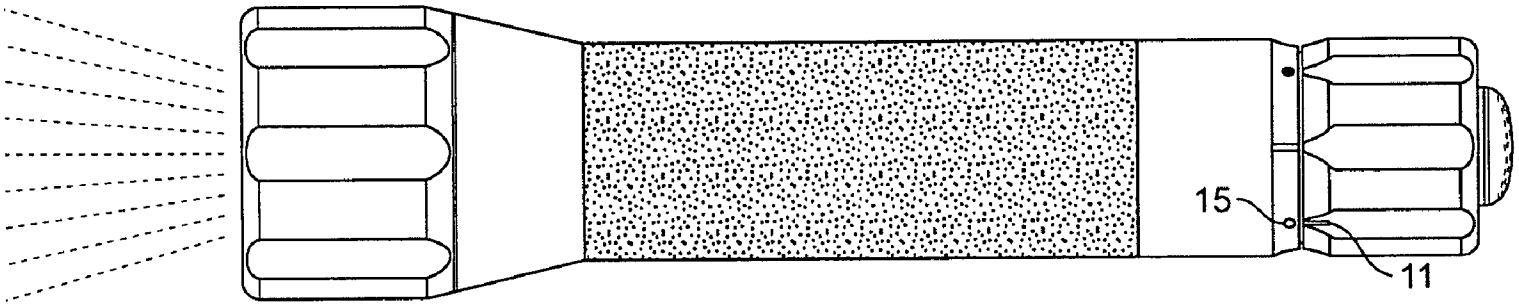
FIG. 4 shows the flashlight of FIG. 1 with the mode selector in a second position.

The mode selection cap 18 also has a second position of rotation wherein the light source activates only for so long as the pushbutton 20 is activated. The second position is shown in FIG. 4 and is defined by alignment between the line 11 and open circle 15.

The mode selector cap 18 also has a third position of rotation wherein the light source transitions from an OFF to an ON state or from an ON to an OFF state once each time the pushbutton 20 is activated. The third position is shown in FIG. 2 and is defined by alignment between the line 11 and closed circle 17.

The flashlight 10 is constructed so that when the flashlight is held in a palm of a user's left hand, the second position can be achieved by grasping the mode selection cap between the user's thumb and forefinger and pushing with the thumb while pulling with the forefinger. Alternatively, when the flashlight is held in a palm of a user's right hand, the first position can be achieved by grasping the mode selection cap between the user's thumb and forefinger and pushing with the thumb while pulling with the forefinger.

Figure 9:
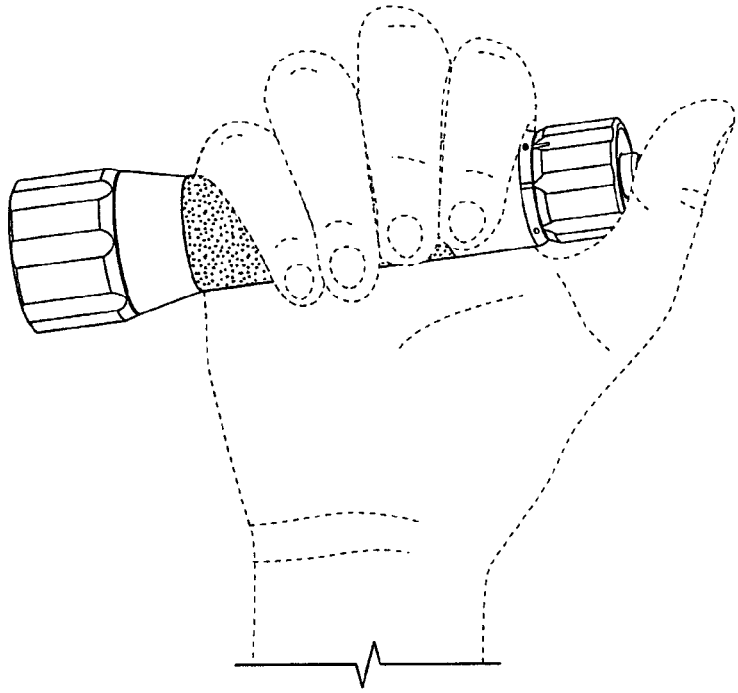
FIG. 9 shows the flashlight of FIG. 1 being held by a user in a non-threat hand.
Figure 10:
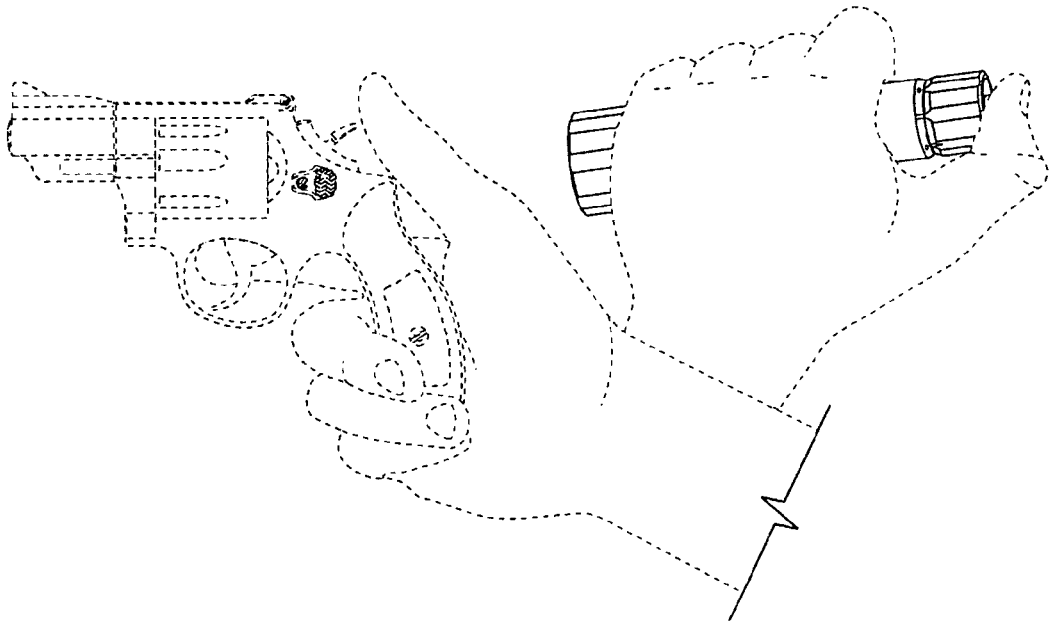
FIG. 10 shows the flashlight of FIG. 1 being held by a user in a threat hand with a weapon in the other hand.

This arrangement is a safety feature for a police officer who preferentially uses one hand (e.g., a right hand) for a weapon (e.g., a firearm). This arrangement is a safety feature because if the police officer is holding a gun in his right hand and the flashlight 10 in his left hand as shown in FIG. 10, then the officer would not want to activate the flashlight 10 in a mode where the flashlight 10 remains activated after the pushbutton 20 is released. Under this naming convention, the officer's left hand is referred to as the "threat hand" for holding the flashlight 10 and the right hand is referred to as the "safe hand" for holding the flashlight 10. This terminology is used because if the officer is holding the flashlight 10 in his/her right hand (i.e. the safe hand) as shown in FIG. 9, then the officer does not feel threatened and would want the flashlight 10 to remain activated after the first activation of the pushbutton 20. On the other hand, if the officer is holding the flashlight in his/her "threat hand", then the officer feels threatened and may or may not have his gun drawn in his right hand. In the situation where the officer feels threatened, the officer will use a mode of flashlight use called "flicking." In this case, the officer will flick the pushbutton 20 of the flashlight to momentarily illuminate a target. The short time of activation allows the officer to view a target without leaving himself/herself exposed to weapons fire.

It should be noted that while the flashlight 10 is intended for a right-handed officer, a left-handed officer could also use the flashlight 10. In the case of the left-handed officer, the officer would have to be trained to pull with his thumb and push with his/her forefinger. The naming convention of threat and safe hand would also be reversed.

Figure 6:
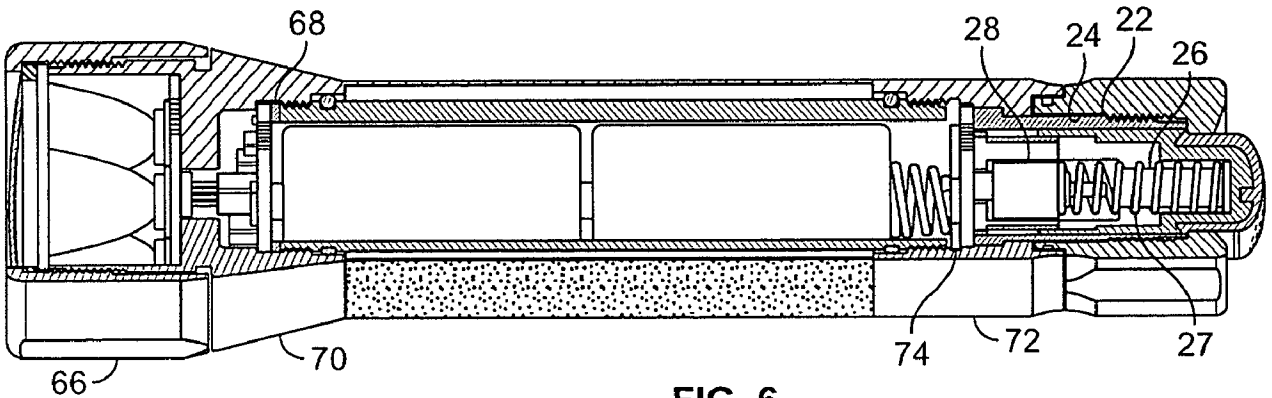
FIG. 6 is a cut-away view of the flashlight of FIG. 1 shown with two batteries.

Turning to FIG. 6, the switch control assembly 14 will be discussed first. FIG. 6 is a cut-away view of the flashlight 10. As shown in FIG. 6, an axially extending rib 22 on a side of the pushbutton 20 and complementary slot 24 on an inside surface of the mode selector cap 18 allows the pushbutton 20 to be pushed towards the flashlight in a direction parallel to the predominant axis 19 against the force of a spring 27 when a user activates a proximal end of the pushbutton 20 with his finger. Since the rib 22 and slot 24 are parallel to the predominant axis 19, the pushbutton 20 can easily be pushed inward by the user's thumb without moving the mode selector 18 and wherein the spring 27 will return the pushbutton 20 to a deactivated state when the pushbutton 20 is released. However, when the mode selector 18 is rotated, the rib 22 and complementary slot 24 also causes the pushbutton 20 to rotate in unison with the mode selector 18.

A distal end of the pushbutton 20 (i.e., inside the flashlight 10) is provided with an inside aperture 29 that extends over a switch assembly 30 (FIG. 5) and allows a pin 26 on an inside of the pushbutton 20 to activate a switch 28 of the switch assembly 30 when the mode selector 18 is in its second and third positions.

In this regard, the distal end of the pushbutton 20 has an inside diameter that is slightly larger than an outside diameter of the switch assembly 30. One or more axially extending ribs 32 (FIG. 3) on the outside surface of the switch assembly 30 engages a set of complementary slots 34 on an inside surface of the pushbutton 20.

The ribs 32 and slots 34 prevent relative axial movement of the pushbutton 20 and switch assembly 30 unless the mode selector 18 is in one of the first, second or third positions. As noted above, the mode selector 18 and pushbutton 20 must rotate together because of the rib 22 on the outside of the pushbutton 20 and slot 24 on the outside of the mode selector 18 and therefore the rotational position of the mode selector 18 also defines the rotational position of the pushbutton 20.

A projection 38 on a switch assembly 30 (FIG. 3A) engages a switch control profile 36 that extends around the periphery of the distal end of the pushbutton 20. In the first, second and third positions of the mode selector 18, a different portion of the profile 36 of the pushbutton 20 bottoms out against the projection 38 when the pushbutton 20 is activated by a user.

Figure 3A:
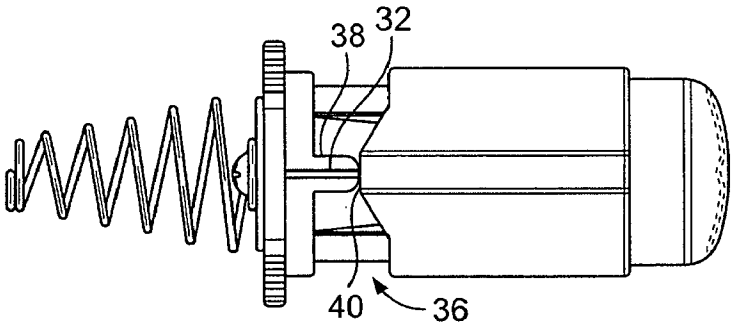
FIGS. 3A-B show operational details of the switch assembly of the flashlight of FIG. 3 with the mode selector in the first position.
Figure 3B:
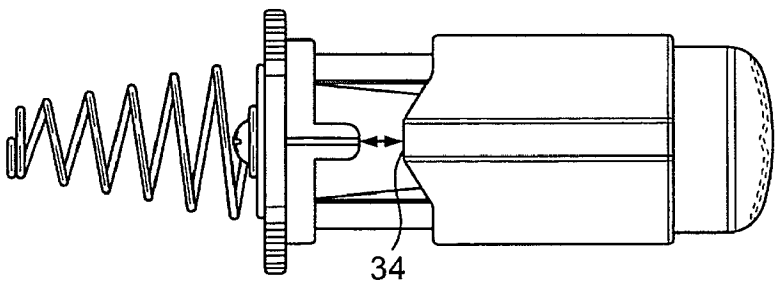

FIG. 3A shows the pushbutton 20 and switch assembly 30 with the mode selector in the first position and with the pushbutton 20 in an activated state. FIG. 3B shows the pushbutton 20 and switch assembly 30 with the mode selector in the first position and with the pushbutton 20 in a deactivated state.

In the first position of the mode selector 18, the projection 38 engages a first portion 40 of the control profile 36 (FIG. 3A). The first portion 40 is an extended portion of the tubular body of the pushbutton 20 that allows only a limited movement of the pushbutton 20 into the housing 12. The limited movement of the pushbutton 20 prevents the pin 26 from contacting the switch 28.

Figure 4A:
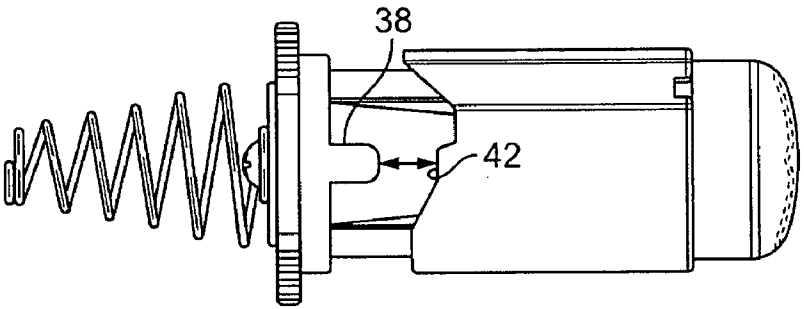
FIGS. 4A-B show operational details of a switch assembly of the flashlight of FIG. 4 with the mode selector in the second position.
Figure 4B:
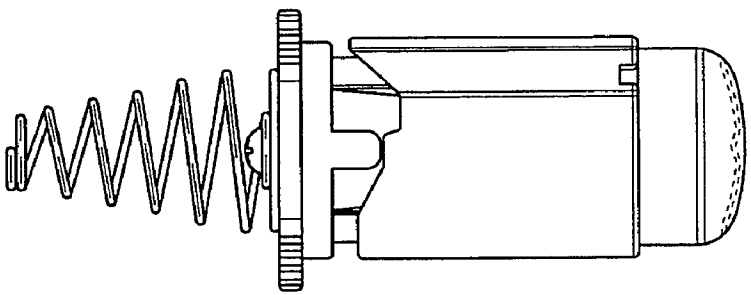

FIG. 4A shows the pushbutton 20 and switch assembly 30 with the mode selector in the second position and with the pushbutton 20 in an activated state. FIG. 4B shows the pushbutton 20 and switch assembly 30 with the mode selector in the second position and with the pushbutton 20 in a deactivated state.

When the mode selector cap 18 is rotated to the second position (FIG. 4), the projection 38 contacts a second portion 42 of the control profile 36 (FIG. 4B). The second portion 42 allows the pushbutton 20 to be advanced into the housing 12 to a second position that is further into the flashlight 10. In the second position, the pin 26 engages the switch 28 to move an activation pin of the switch 28 a first distance.

The switch 28 is a wiping contact type switch with two modes of operation. If the switch is moved the first distance, the switch 28 operates as a momentary contact switch 28. If the switch is moved any further, then the switch 28 operates as a toggle switch that maintains the switch status (i.e., open or closed) until it is again toggled.

With the mode selector 18 in the second position, the switch 28 operates as a momentary contact switch. As such, when the user activates the pushbutton 20, the switch 28 completes the circuit and activates the flashlight 10. When the user releases the pushbutton 20, the flashlight 10 automatically becomes deactivated.

Figure 2A:
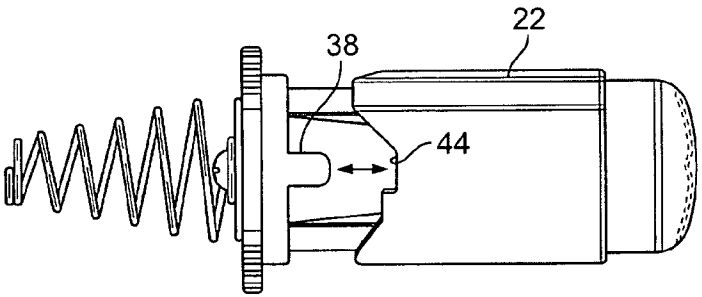
FIGS. 2A-B show operational details of a switch assembly of the flashlight of FIG. 2 with the mode selector in the third position.
Figure 2B:
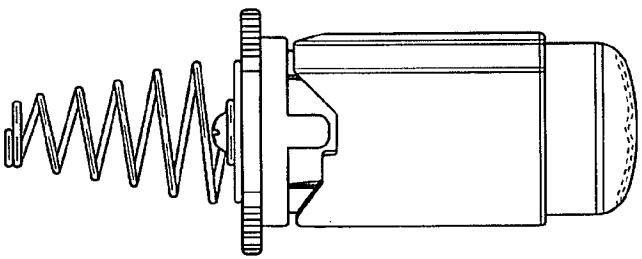

FIG. 2A shows the pushbutton 20 and switch assembly 30 with the mode selector in the third position and with the pushbutton 20 in an activated state. FIG. 2B shows the pushbutton 20 and switch assembly 30 with the mode selector in the third position and with the pushbutton 20 in a deactivated state.

When the user moves the mode selector 18 into the third position (FIG. 2), the portion 44 contacts the projection 38 (FIG. 2B). In this mode, the pin 26 encounters and advances the activation pin of the switch 28 sufficiently to toggle the switch 28. In this situation, the flashlight 10 remains activated when the user releases the pushbutton 20. To deactivate the flashlight 10, the user must activate the pushbutton 20 a second time.

The light source assembly 16 will now be discussed. Returning now to FIG. 5, the light source assembly 16 contains a power control circuit board 50 and a light emitting diode (LED) circuit board 52. The power control board 50 and LED circuit board 52 are orthogonal to the predominant axis 19. The power control board 50 and LED circuit board 52 are detachably interconnected via a set of push-on electrical connectors 58, 60. One set of male connectors (e.g., connector set 58) is attached (e.g., soldered) to one circuit board (e.g., the LED circuit board 52) and the other set of female connectors (e.g., connector set 60) is attached (e.g., soldered) to the other circuit board (e.g., the power control board 50. As such, the power circuit board 50 and LED circuit board 52 shown in FIG. 5 can easily be pulled apart and reconnected via the push-on connectors 58, 60.

Figure 5:
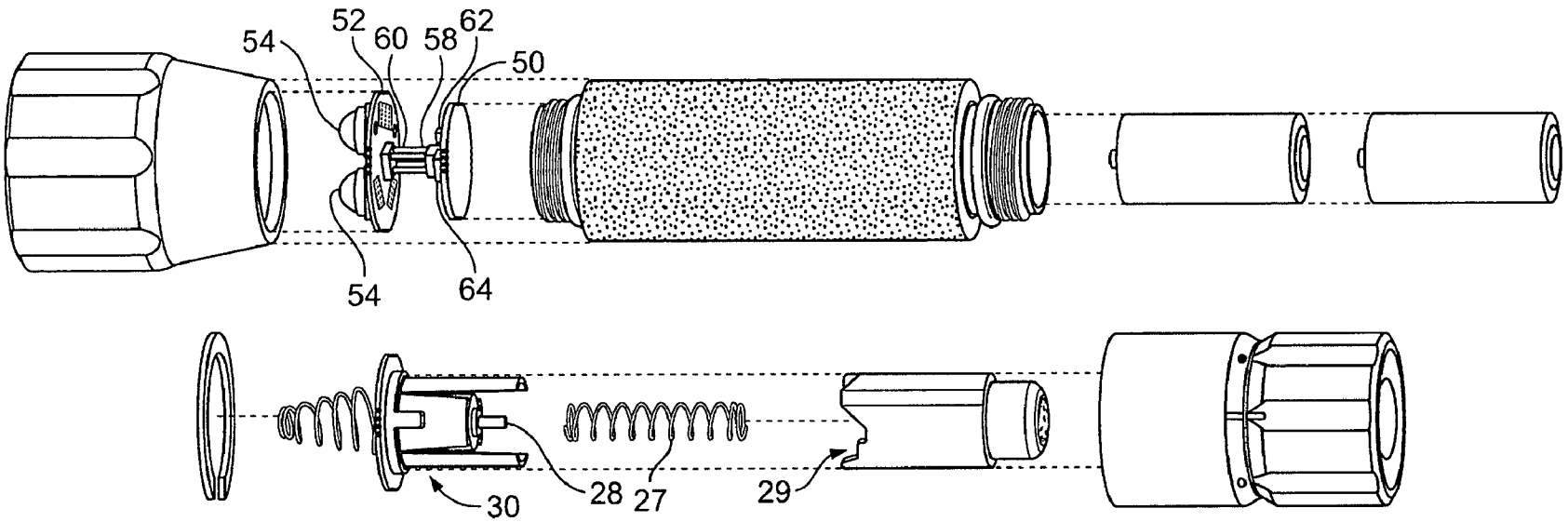
FIG. 5 is an exploded view of the flashlight of FIG. 1.
Figure 7:
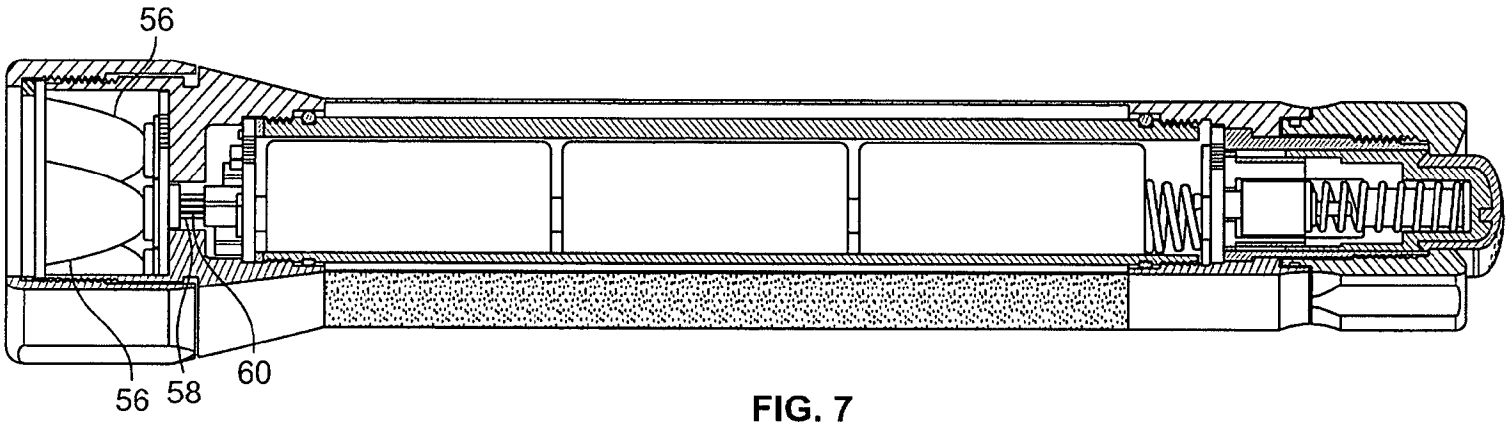
FIG. 7 is a cut-away view of the flashlight of FIG. 1 under an alternate embodiment wherein the housing of the flashlight of FIG. 1 contains three batteries.

Included on the LED circuit board 52 may by one or more LEDs 54 and associated reflectors 56 (FIGS. 5 and 7). In one preferred embodiment, three LEDs 54 are used. The LEDs 54 may be connected in series between respective connectors 58 on the LED board 52 to equalize the current among the LEDs 54. A ten volt potential may be applied across the series connected LEDs 54.

The reflectors 56 provide a peripheral flood beam and a central penetrating beam that projects a strong central beam for a relatively long distance. The peripheral flood beam projects light at a predetermined light level (e.g., 5 lumens) over a relatively wide angle (e.g., 90 degrees) from the predetermined axis of light transmission from the flashlight so that a user can at least minimally observe obstacles and threats off the main axis of the flashlight. The penetrating beam is directed at a relatively small axis (e.g., a few degrees) from the predominant axis of the flashlight so that a user can identify any danger at relatively long distances presented by a person with a weapon. The peripheral flood beam and strong central beam is created by the appropriate parabolic shape of the reflector 56 and also by the alignment of the reflectors 56 with respect to the predominant axis of the flashlight.

Figure 8:
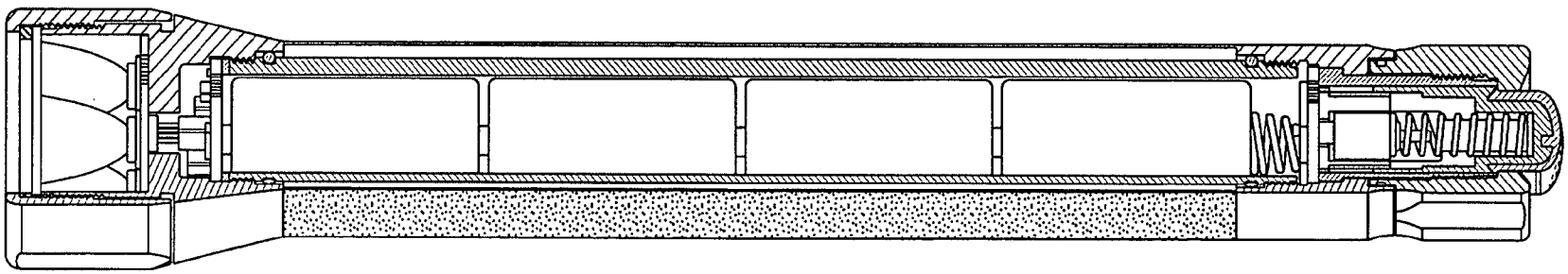
FIG. 8 is a cut-away view of the flashlight of FIG. 1 under another alternate embodiment wherein the housing of the flashlight of FIG. 1 contains four batteries.

The power control board 50 may include a number of integrated circuits 62, 64 that function as a buck and boost circuit. It should be noted in this regard that the flashlight 10 may be provided with a number of different housings 12 shown in FIGS. 6, 7 and 8. One housing 12 may be provided with a length that contains two 3-volt lithium batteries (FIG. 6). Another housing 12 may be provided that holds three 3-volt lithium batteries (FIG. 7). A third housing may be provided that holds four 3-volt lithium batteries (FIG. 8).

At least one of the integrated circuits (e.g., circuit 62) may be a voltage sensor and the other circuit (e.g., 64) is a buck and boost circuit 64. The voltage sensor 62 functions to detect the voltage of the batteries within a battery compartment 64 and either buck or boost the battery voltage to provide a constant 10-volt potential to the LEDs 54. For example, if the housing 12 contains only two 3-volt batteries, then the voltage sensor 62 will detect that the battery voltage is 6 volts. In this case, the voltage sensor 62 may instruct the buck and boost circuit 64 to boost the battery voltage by 4 volts in order to apply 10 volts to the series connected LEDs 54. Similarly, if the housing 12 contains four batteries then the voltage sensor 62 may detect a battery voltage of 12-volts and would instruct the buck and boost circuit 64 to reduce the battery voltage to 10-volts.

The buck and boost circuit 64 provides a number of benefits. On a first level, the reduction of voltage applied to the LEDs 54 extends a useful life of the batteries.

In addition, the buck and boost circuit 64 also prevents damage to the LEDs 54 due to overheating. In order to achieve a good light output, the voltage applied to the LEDs 54 may be as much as 140% of a rated voltage for the LEDs 54. However, the fact that the buck and boost circuit 64 maintains the voltage at a constant level allows the LEDs 54 to be powered at a relatively high voltage without a significant reduction in LED life.

The buck and boost circuit 64 also maintains a comfort level for a user. In this regard, the buck and boost circuit 64 controls the heat generated within the LEDs 54 so that a temperature of the outside surface of the flashlight is less than 140° F. This prevents the case of the flashlight from becoming overly warm or burning the hands of a user.

The use of a replaceable housing 12 that may contain different numbers of batteries allows the flashlight 10 to be instantly reconfigured for different uses. If the user has a relatively short mission, then the shorter housing (shown in FIG. 6 containing only two batteries) would be used. If the mission is longer, then a longer housing 12 (e.g., as shown in FIG. 7 or 8) would be used to extend the useful life of the flashlight 10 in any particular mission.

In addition, the bi-directional nature of a mode selector 18 increases the safety of the user. In each case, the first or third modes (selected via the mode selector 18) of the flashlight 10 is determined by the hand in which the flashlight 10 is held. This method of operation materially improves the safety of the user because the user simply selects the mode using the same mechanical operation of pushing with his/her thumb and pulling with his forefinger rather than forcing the user to consciously think of which mode is being selected.

Moreover, the flashlight 10 can be easily repaired in the event of failure. For example, if the LED circuit board 52 should fail, a user may simply unscrew a lenscap 66 and pull the LED circuit board 52 out through the face of the flashlight 10 without tools. A replacement LED circuit board 52 may be installed by reversing the process.

Similarly, the power circuit board 50 may be removed and replaced by unscrewing a front cap 70 and removing a snap ring 68 to access the power circuit board 50. The switch assembly 30 may be replaced by a similar process involving unscrewing a switch case cap 72 and removing another snap ring 74.

Further, it will be understood that the flashlights of the present invention can be modified without departing from the teachings of the invention. Accordingly, the scope of the invention is only to be limited as necessitated by the accompanying claims.

The invention claimed is:

1. A flashlight comprising:

a cylindrical housing;

a LED light source disposed on a first end of the housing with an axis of transmission of the LED parallel to the predominant axis of the light and baton housings;

a rotatable mode selector cap extending axially from a second end of the housing and that rotates around a predominant axis of the housing; and a spring-loaded pushbutton extending axially from a distal end of the mode selector cap, the mode selector cap having a first position of rotation wherein the light source cannot be activated, a second position of rotation wherein the light source activates only so long as the pushbutton is activated and a third position of rotation wherein the light source transitions between an OFF to ON state or a ON to OFF state once each time the pushbutton is activated and released.

2. The flashlight as in claim 1 wherein mode selection cap further comprises a direction of rotation so that when the flashlight is held in a palm of a user's left hand, the second position can only be achieved by grasping the mode selection cap between the user's thumb and forefinger and pushing with the thumb while pulling with the forefinger.

3. The flashlight as in claim 1 wherein mode selection cap further comprises a direction of rotation so that when the flashlight is held in a palm of a user's right hand, the first position can only be achieved by grasping the mode selection cap between the user's thumb and forefinger and pushing with the thumb while pulling with the forefinger.

4. The flashlight as in claim 1 wherein the light source further comprises a plurality of LEDs disposed on the first end of the housing with an axis of transmission of the LEDs parallel to the predominant axis of the housing.

5. The flashlight as in claim 1 wherein the light source further comprises a an LED circuit board that supports the LEDs, the LED circuit board disposed between the light source and housing perpendicular to the predominant axis of the housing.

6. The flashlight as in claim 4 further comprising a parabolic reflector disposed behind each of the plurality of LEDs and oriented so that the flashlight provides a peripheral flood beam that provides a predetermined minimum light level at a broad angle around the predominant axis and a central penetrating beam no more than a few degrees on either side of the predominant axis that projects light a relatively long distance to illuminate danger posed by a person with a weapon.

7. The flashlight as in claim 5 wherein the light source further comprises a power circuit board that controls power to the LED light source, the power circuit board disposed between the LED circuit board and the housing.

8. The flashlight as in claim 7 wherein the light source further comprises a first connector plug disposed on the LED circuit board and a second mating connector plug disposed on the power circuit board, the first and second connector plugs slidably engaging one another along the predominant axis of the housing.

9. The flashlight as in claim 7 wherein the power circuit board further comprises a buck and boost circuit that applies a predetermined voltage to the light source where the buck and boost circuit boosts a battery voltage to the light source when the battery voltage is below the predetermined voltage and reduces the battery voltage to the light source when the battery voltage exceeds the predetermined voltage.

10. A flashlight comprising:

a cylindrical housing having a predominant axis;

a LED light source disposed on a first end of the cylindrical housing with an axis of light transmission parallel to the predominant axis of the cylindrical housing;

an LED circuit board that supports the LED light source disposed between the light source and cylindrical housing perpendicular to the predominant axis of the housing;

a power circuit board that controls power to the LED light source disposed between the first circuit board and the housing;

a first connector plug disposed on the LED circuit board; and a second mating connector plug disposed on the power circuit board, the first and second connector plugs slidably engaging one another along the predominant axis of the cylindrical housing.

11. The flashlight as in claim 10 further comprising a rotatable mode selector cap extending axially from a second end of the housing and that rotates around a predominant axis of the housing.

12. The flashlight as in claim 11 further comprising a spring-loaded pushbutton extending axially from a distal end of the mode selector cap, the mode selector cap having a first position of rotation wherein the light source cannot be activated, a second position of rotation wherein the light source activates only so long as the pushbutton is activated and a third position of rotation wherein the light source transitions between an OFF to ON state or a ON to OFF state each time the pushbutton is activated.

13. The flashlight as in claim 12 wherein mode selection cap further comprises a direction of rotation so that when the flashlight is held in a palm of a user's left hand, the second position can only be achieved by grasping the mode selection cap between the user's thumb and forefinger and pushing with the thumb while pulling with the forefinger.

14. The flashlight as in claim 12 wherein mode selection cap further comprises a direction of rotation so that when the flashlight is held in a palm of a user's right hand, the first position can only be achieved by grasping the mode selection cap between the user's thumb and forefinger and pushing with the thumb while pulling with the forefinger.

15. The flashlight as in claim 10 wherein the light source further comprises a plurality of LEDs disposed on the LED circuit board.

16. The flashlight as in claim 10 wherein the power circuit board further comprises a buck and boost circuit that applies a predetermined voltage to the light source where the buck and boost circuit boosts a battery voltage to the light source when the battery voltage is below the predetermined voltage and reduces the battery voltage to the light source when the battery voltage exceeds the predetermined voltage.

17. A flashlight comprising:

a LED light source;

a power circuit that provides power to the LED light source;

a buck and boost power controller within the power circuit in series with the LED light source where the buck and boost circuit boosts a battery voltage to the light source when the battery voltage is below a predetermined voltage and reduces the battery voltage to the light source when the battery voltage exceeds the predetermined voltage to provide a longer run time for the flashlight a plurality of push-on electrical connector sets connecting the LED light source and buck and boost controller, each push-on electrical connector of the connectors sets further comprising a respective male and female connector that can be pulled apart and reconnected without tools; a cylindrical housing with the LED light source disposed on a first end of the housing and a rotatable mode selector cap extending axially from a second end of the housing and that rotates around a predominant axis of the housing to select a mode projection selected from the group consisting of an OFF projection, a momentary contact projection and a toggling projection, a spring-loaded pushbutton extending axially from a distal end of the mode selector cap, the mode selector cap having a first position of rotation wherein the light source cannot be activated, a second position of rotation wherein the light source activates only so long as the pushbutton is activated and a third position of rotation wherein the light source transitions between an OFF to ON state or a ON to OFF state each time the pushbutton is activated and released.

18. The flashlight as in claim 17 wherein mode selection cap further comprises a direction of rotation so that when the flashlight is held in a palm of a user's left hand, the second position can only be achieved by grasping the mode selection cap between the user's thumb and forefinger and pushing with the thumb while pulling with the forefinger.

19. The flashlight as in claim 17 wherein mode selection cap further comprises a direction of rotation so that when the flashlight is held in a palm of a user's right hand, the first position can only be achieved by grasping the mode selection cap between the user's thumb and forefinger and pushing with the thumb while pulling with the forefinger.

* * * * *